US009218768B2

(12) United States Patent
Lee

(10) Patent No.: US 9,218,768 B2
(45) Date of Patent: Dec. 22, 2015

(54) ORGANIC LIGHT-EMITTING DIODE DISPLAY DEVICE

(71) Applicant: LG DISPLAY CO., LTD., Seoul (KR)

(72) Inventor: HoYoung Lee, Paju (KR)

(73) Assignee: LG DISPLAY CO., LTD., Seoul (KR)

( * ) Notice: Subject to any disclaimer, the term of this patent is extended or adjusted under 35 U.S.C. 154(b) by 182 days.

(21) Appl. No.: 13/728,209

(22) Filed: Dec. 27, 2012

(65) Prior Publication Data

US 2014/0092076 A1 Apr. 3, 2014

(30) Foreign Application Priority Data

Sep. 28, 2012 (KR) ..... 10-2012-0109252

(51) Int. Cl.
*G09G 3/32* (2006.01)

(52) U.S. Cl.
CPC ..... *G09G 3/3291* (2013.01); *G09G 2300/0819* (2013.01); *G09G 2300/0842* (2013.01); *G09G 2310/0297* (2013.01)

(58) Field of Classification Search
USPC ..... 345/204, 30, 55, 211, 87, 90, 94
See application file for complete search history.

(56) References Cited

U.S. PATENT DOCUMENTS

| | | | | |
|---|---|---|---|---|
| 5,353,138 | A * | 10/1994 | Van Winsum | 349/41 |
| 8,289,247 | B2 * | 10/2012 | Min et al. | 345/82 |
| 2005/0134541 | A1 * | 6/2005 | Jang et al. | 345/94 |
| 2007/0120780 | A1 | 5/2007 | Park et al. | |
| 2009/0051628 | A1 * | 2/2009 | Kwon | 345/77 |
| 2010/0073357 | A1 | 3/2010 | Min et al. | |
| 2011/0175858 | A1 * | 7/2011 | Lee et al. | 345/204 |
| 2012/0280962 | A1 * | 11/2012 | Kawabe | 345/211 |
| 2013/0050292 | A1 * | 2/2013 | Mizukoshi | 345/690 |

FOREIGN PATENT DOCUMENTS

| | | | |
|---|---|---|---|
| CN | 101004885 | A | 7/2007 |
| CN | 101123071 | A | 2/2008 |
| CN | 101373578 | A | 2/2009 |
| KR | 1020050035550 | A | 4/2005 |

(Continued)

OTHER PUBLICATIONS

Notice of Allowance issued in Korean Patent Application No. 10-2012-0109252, mailed Nov. 25, 2014, 2 pages.

(Continued)

*Primary Examiner* — Jason Olson
*Assistant Examiner* — Deeprose Subedi
(74) *Attorney, Agent, or Firm* — Brinks Gilson & Lione

(57) ABSTRACT

Disclosed an organic light-emitting diode display device in which the number of signal lines is minimized by sharing a predetermined signal line between adjacent pixels in a display panel having a plurality of signal lines formed therein, thereby improving an aperture ratio. The organic light-emitting diode display device includes a display panel defining pixels, a gate driver, a data driver, a multiplexer (MUX) electrically connecting an output terminal of the data driver and the pixels into a 1:1, 1:N (N is a natural number) or N:N structure, and a timing controller. Accordingly, the MUX is provided between the data driver and the pixels, and each pixel and signal lines are selectively connected through the MUX, so that it is possible to reduce the number of Integrated chips (ICs) provided by allowing a compensation circuit built in the data driver.

14 Claims, 10 Drawing Sheets

(56) References Cited

FOREIGN PATENT DOCUMENTS

| | | | |
|---|---|---|---|
| KR | 1020070031917 | A | 3/2007 |
| KR | 20090090933 | A | 8/2009 |
| KR | 20130107909 | A | 10/2013 |
| TW | 200809744 | A | 2/2008 |
| TW | 201115539 | A | 5/2011 |
| TW | 201137828 | A | 11/2011 |
| TW | 201232514 | A | 8/2012 |

OTHER PUBLICATIONS

Office Action issued in Taiwan Patent Application No. 101149350, mailed Nov. 12, 2014, 9 pages.

Office Action dated May 25, 2015 for corresponding Chinese Patent Application No. 201210570348.5, 12 pages.

* cited by examiner

ORGANIC LIGHT-EMITTING DIODE DISPLAY DEVICE

CROSS-REFERENCE TO RELATED APPLICATIONS

Pursuant to 35 U.S.C. §119(a), this application claims the benefit of earlier filing date and right of priority to Korean Application No. 10-2012-0109252, filed on Sep. 28, 2012, the contents of which is incorporated by reference herein in its entirety.

BACKGROUND

1. Field of the Disclosure

The present disclosure relates to an organic light-emitting diode display device, and particularly, to an organic light-emitting diode display device in which the number of signal lines is minimized by sharing a predetermined signal line between adjacent pixels in a display panel having a plurality of signal lines formed therein, thereby improving an aperture ratio.

2. Description of the Conventional Art

Flat panel displays as substitutes for existing cathode ray tubes are a liquid crystal display device, a field emission display device, a plasma display panel device, an organic light-emitting diode display device, etc.

Among these flat panel displays, the organic light-emitting diode display device has characteristics of high-luminance and low operating voltage. Since the organic light-emitting diode display device is a self-luminescent display device that emits light by itself, its contrast ratio is high, and the implementation of an ultra-thin display is possible. Since the organic light-emitting diode display device has a response time of about a few microseconds (μm), the implementation of moving images is easier than that in the liquid crystal display device. Further, the organic light-emitting diode display device has no limitation of viewing angle, and is stable even at a low temperature.

In a typical organic light-emitting diode display device, one pixel includes at least two switching and driving transistors, a capacitor and a light-emitting diode. The switching transistor applies a data voltage corresponding to the gray scale of an image to a gate of the driving transistor, and the driving transistor supplies current to the light-emitting diode according to the data voltage, thereby displaying the image. In this case, there may occur a difference in threshold voltage between the driving transistors of each pixel, which results in MURA of an image.

In order to solve such a problem, an internal compensation method and an external compensation method have been proposed. In the internal compensation method, a plurality of auxiliary transistors are further formed in each pixel so as to sample the threshold voltage of a driving transistor in the pixel and to compensate for the sampled threshold voltage. In the external compensation method, a second switching transistor applying a reference voltage is further provided, and a variation in the reference voltage applied by the second switching transistor is sensed, so as to compute a difference in threshold voltage between driving transistors through the sensed variation and to compensate for a data voltage.

In the internal compensation method, six thin film transistors including switching and driving transistors are provided in each pixel. Therefore, the configuration of a circuit is complicated, and an aperture ratio is decreased. On the other hand, in the external compensation method, each pixel can be implemented with no more than three thin film transistors, and it is possible to sense not only a difference in threshold voltage between driving transistors but also the amount of current flowing through the driving transistor. Thus, a variation in carrier mobility can also be computed, thereby maximizing compensation capability for a variation in element characteristic.

FIG. 1A is an equivalent circuit diagram of one pixel in a conventional organic light-emitting diode display device using an external compensation method. FIG. 1B is a waveform diagram illustrating waveforms of signals applied in driving of the pixel shown in FIG. 1A. FIG. 1C is a schematic diagram of the organic light-emitting diode display device using the external compensation method.

Referring FIG. 1A, the conventional organic light-emitting diode display device using the external compensation method includes an organic light-emitting diode D1, a driving transistor DR-T supplying current to the organic light-emitting diode D1, a first switching transistor SW-T1 connected between a data line and the driving transistor DR-T so as to apply a data voltage to a gate of the driving transistor DR-T according to a first scan signal Vscan, a second switching transistor SW-T2 connected between a reference voltage supply (not shown) and the driving transistor DR-T so as to apply a reference voltage to a source of the driving transistor DR-T according to a second scan signal Vscan2, and a capacitor C1 connected between the gate and source of the driving transistor DR-T.

According to the structure described above, if high-level first and second scan signals Vscan1 and Vscan2 are applied to each pixel, current flows through the first and second switching transistors SW-T1 and SW-T2 so that a data voltage Vdata is applied to the gate of the driving transistor DR-T, and a reference voltage Vref is applied to the source of the driving transistor DR-T, and a voltage of "VDD-|Vth|" and "Vdata" to both ends of the capacitor C1. Subsequently, if the voltage level of the first scan signal Vscan1 is changed into a low level and thus the first switching transistor SW-T1 is turned off, a voltage of "VDD−|Vth|−Vdata+Vref" is applied to the gate of the driving transistor DR-T, and as a result, the Ids of the driving transistor DR-T becomes "$k(Vdata-Vref)^2$." That is, a threshold voltage component is removed in the current flowing through the driving transistor DR-T, so that the current flowing through the driving transistor DR-T is controlled by the reference voltage Vref. Thus, a variation in element characteristic between pixels can be compensated by sensing current flowing through the driving transistor DR-T according to the variation (V0-V1) of the reference voltage Vref for a predetermined time t, computing a compensation value through the sensed current and reflecting the computed compensation value to the data voltage.

However, in the organic light-emitting diode display device using the external compensation method described above, as shown in FIG. 1C, a compensation circuit 40 for supplying and sensing the reference voltage Vref is further required in addition to a data driver 30 supplying the data voltage Vdata. Therefore, separate Integrated chips (ICs) are respectively provided to upper and lower portions of a display panel 10, which results in an increase in cost.

Although the external compensation method is applied to the organic light-emitting diode display device, the organic light-emitting diode display device is identical to that using the internal compensation method in that a plurality of signal lines such as a line for supplying the reference voltage Vref and a line for supplying power and ground voltages VDD and VSS are formed in the display panel 10. Accordingly, there is a limitation in improving an aperture ratio.

SUMMARY

An organic light-emitting diode display device includes a display panel having a plurality of signal lines formed thereon, and including a plurality of pixels each having first and second switching transistors, a driving transistor and a light-emitting diode; a gate driver allowing current to flow through the first and second switching transistors through a gate line; a data driver computing a variation in threshold voltage of the driving transistor by sensing a change in reference voltage applied through the signal lines, and compensating for a data voltage applied to the driving transistor and supplying the compensated data voltage to the pixel; a multiplexer (MUX) electrically connecting output terminals of the data driver and the pixels into a 1:1, 1:N (N is a natural number) or N:N structure; and a timing controller controlling the gate driver, the data driver and the MUX.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWING

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF EXEMPLARY EMBODIMENTS

Description will now be given in detail of the exemplary embodiments, with reference to the accompanying drawings. For the sake of brief description with reference to the drawings, the same or equivalent components will be provided with the same reference numbers, and description thereof will not be repeated.

Figure 2:
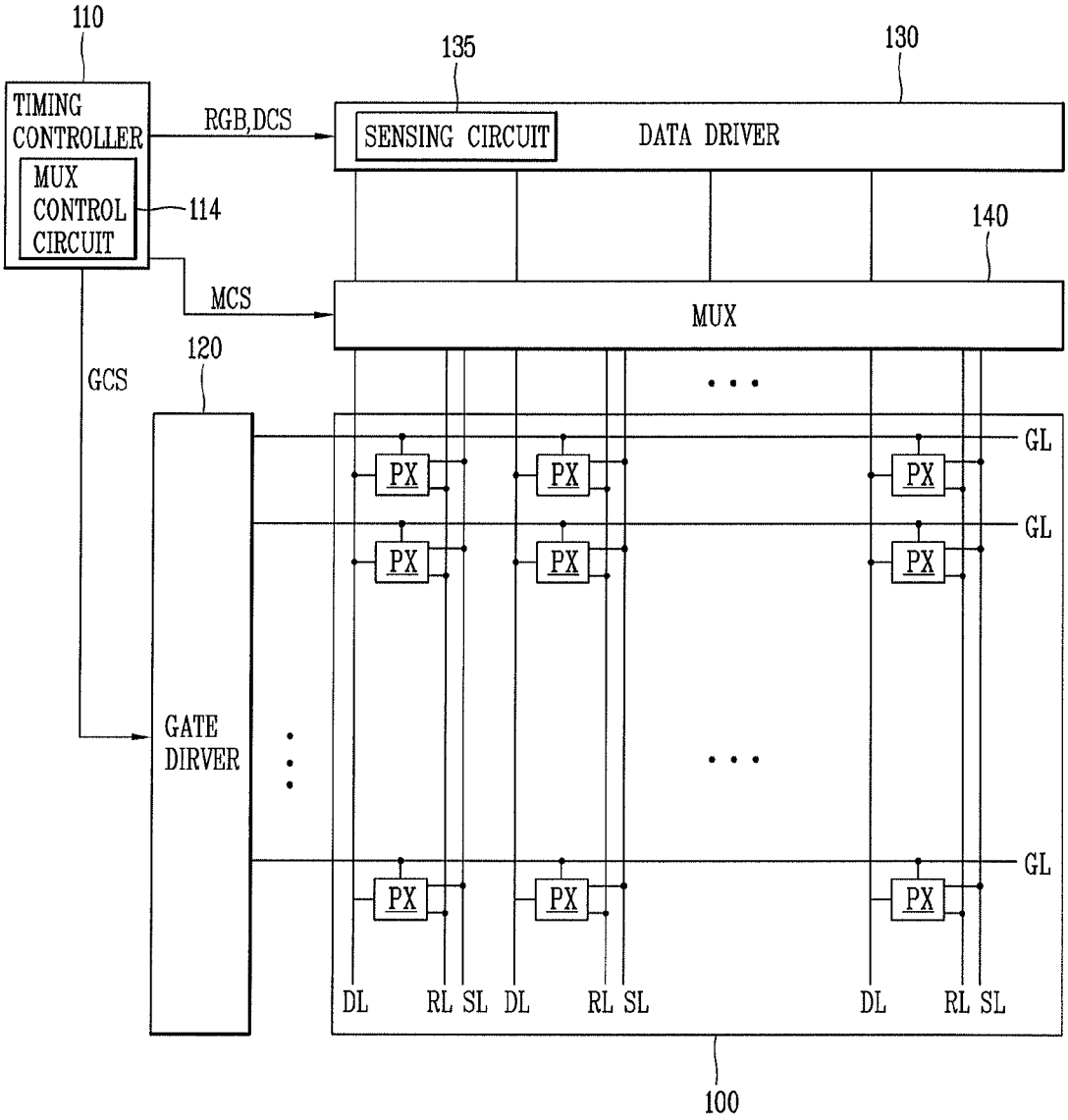
FIG. 2 is a block diagram illustrating the entire structure of an organic light-emitting diode display device according to an exemplary embodiment.

FIG. 2 is a block diagram illustrating the entire structure of an organic light-emitting diode display device according to an exemplary embodiment.

As shown in this figure, the organic light-emitting diode display device according to the exemplary embodiment includes a display panel 100 implementing an image divided into a display area in which the image is displayed and a non-display area positioned at the outside of the display area, a timing controller 110 generating a control signal by receiving a timing signal from an external system, and aligning and changing image signals, a gate driver 120 connected to one side of the display panel 100 so as to apply a scan signal to gate lines GL, a data driver 130 applying a data voltage to each pixel, and a multiplexer (MUX) 140 connected to the one side of the display panel 100 so as to select reference supply and sensing lines RL and SL for supplying and sensing a reference voltage Vref and signal lines DL through which the data voltage is output.

In the display panel 100, a plurality of gate lines GL and a plurality of data lines DL are formed to intersect each other in a matrix on a transparent substrate. The gate lines GL are connected to output terminals of the gate driver 120, and the reference voltage supply and sensing lines RL and SL and the data lines DL are connected to output terminals of the data driver 130 through the MUX 140. Pixels PX are defined at intersection portions of the gate and data lines GL and DL. Although not shown in this figure, each pixel PX is connected to a power voltage (VDD) line and a ground voltage (VSS) line.

The pixel PX may include at least two switching and driving transistors SW-T1, SW-T2 and DR-T, an organic light-emitting diode D1 and a capacitor C1.

Figure 1A:
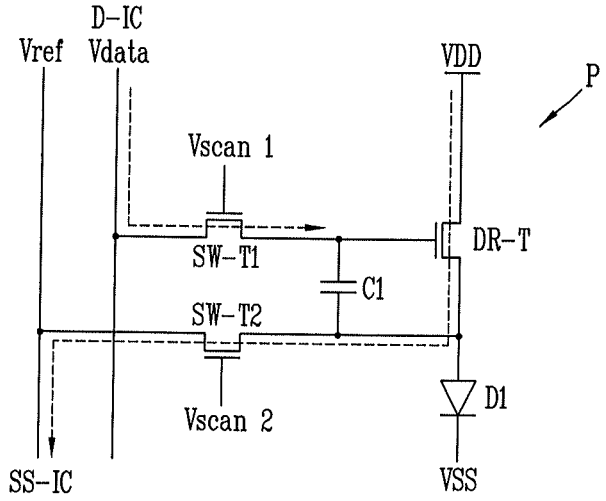
FIG. 1A RELATED ART
FIG. 1A is a equivalent circuit diagram of one pixel in a conventional organic light-emitting diode display device using an external compensation method.
Figure 1B:
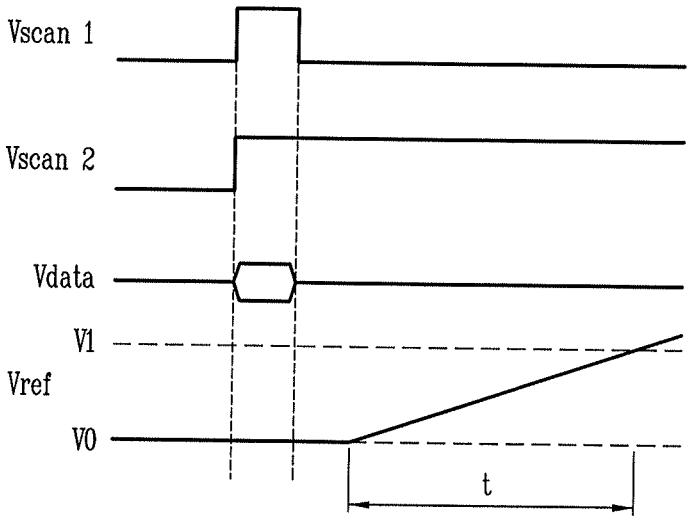
FIG. 1B RELATED ART
FIG. 1B is a waveform diagram illustrating waveforms of signals applied in driving of the pixel shown in FIG. 1A.
Figure 1C:
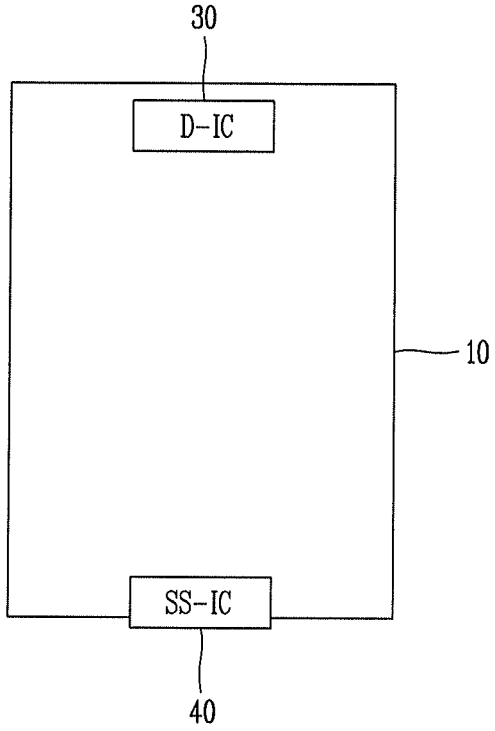
FIG. 1C RELATED ART
FIG. 1C is a schematic diagram of the organic light-emitting diode display device using the external compensation method.

The pixel PX of the organic light-emitting diode display device according to the exemplary embodiment will be described with reference to FIG. 1A. Current flows through the first switching transistor SW-T1 according to a first scan signal Vscan1 input to a gate line GL, a data voltage VDATA according to a gray scale is applied to a gate of the driving transistor DR-T for each pixel so that current corresponding to the data voltage Vdata flows through the organic light-emitting diode D1, thereby displaying an image. In this case, current flows through the second switching transistor SW-T2 according to a second scan signal Vscan2 so that a reference voltage Vref is applied to the driving transistor DR-T and the capacitor C1, and a change in the reference voltage Vref is sensed through a sensing line SL for a predetermined time. The sensed result is reflected to the data voltage Vdata.

The timing controller 110 receives a digital image signal (RGB) transmitted from the external system and timing signals such as a horizontal synchronization signal (Hsync), a vertical synchronization signal (Vsync) and a data enable signal (DE), so as to generate control signals of the gate and data drivers 120 and 130 and a control signal of the MUX 140.

The gate control signal GCS with which the timing controller 110 provides the gate driver 120 includes a gate start pulse (GSP), a gate shift clock (GSC), a gate output enable (GOE), etc.

The data control signal DCS with which the timing controller provides the data driver 130 includes a source start pulse (SSP), a source shift clock (SSC), a source output enable (SOE), etc.

The timing controller 110 generates a MUX control signal (MCS) for controlling a selection of the MUX 140 through a MUX control circuit 114 built therein. The MUX control circuit 114 is not built in the timing controller 110 but may be implemented as a separate Integrated chip (IC). The MUX 140 is configured with a plurality of transistors, and functions to electrically connect the output terminals of the data driver 130 and the pixels PX into a 1:1, 1:N (N is a natural number) or N:N structure. That is, the MUX 140 electrically connects the data driver 130 and the pixels PX at a corresponding timing by allowing current to selectively flow in any one of the reference voltage supply and sensing lines RL and SL and the data line DL.

The timing controller 110 receives image signals (RGB) input from the external system through an ordinary interface, and the input image signal (RGB) is aligned in the form capable of being processed by the data driver 130 and then supplied to the data driver 130.

The gate driver 120 is a shift register configured with a plurality of transistors at one side of the display panel 100, and a gate-in-panel structure in which the gate driver 120 is configured with the plurality of transistors on the display panel 100 may be applied to the organic light-emitting diode display device. The gate driver 120 outputs the first and second scan signals Vscan1 and Vscan2 through the gate lines GL formed on the display panel 100 in response to the gate control signal GCS input from the timing controller 110, and turns on the switching transistors SW-T1 and SW-T2 provided in each pixel PX. Thus, the data voltage Vdata output from the data driver 130 is applied to the driving transistor DR-T of each pixel PX, and the reference voltage Vref is sensed in a predetermined time after the reference voltage Vref is applied to the pixel PX from the reference voltage supply and sensing lines RL and SL.

The data driver 130 applies the data voltage of an analog waveform to the pixels PX through the data lines DL, in synchronization with the output first scan signal Vscan1.

The data driver 130 converts the aligned digital image signals (RGB) input corresponding to the data control signal DCS input from the timing controller 110 into the analog data voltage Vdata according to the reference voltage Vref. In this case, the data driver 130 receives a data compensation value according to the sensed result of the reference voltage from a sensing circuit 135 built therein, and reflects the received data compensation value to the data voltage Vdata. The data driver 130 is configured with a separate Integrated chip (IC) to be attached on one non-display region of the display panel 100 using a TAB or OOG method. The data driver 130 is electrically connected to the data lines DL through the MUX 140 described later. The output terminals may be further connected to a plurality of signal lines, as well as the data lines DL.

The MUX 140 is configured with a plurality of thin film transistors formed between a pixel region of the display panel 100 and the data driver 130. The MUX 140 functions to connect one output terminal of the data driver 130 and a plurality of signal lines to the pixels PX into a 1:1, 1:N (N is a natural number) or N:N structure according to the MUX control signal MCS.

Thus, the MUX 140 enables the data driver 130 to supply the reference voltage to the pixel PX, to sense the reference voltage and to supply the data voltage, through the one output terminal of the data driver 130.

Hereinafter, an example in which the pixels and the output terminals of the data driver are connected into a 1:1, 1:N (N is a natural number) or N:N structure in the organic light-emitting diode display device according to the exemplary embodiment will be described with reference to the accompanying drawings.

Figure 3A:
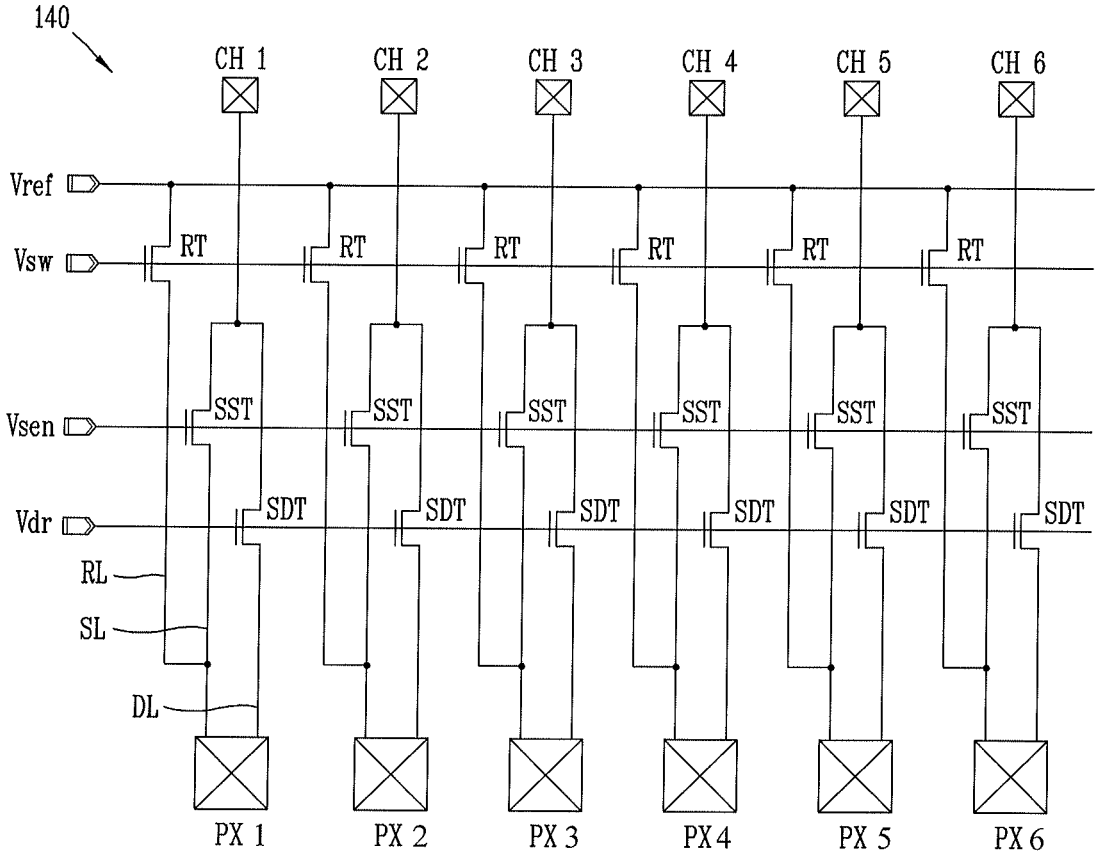
FIGS. 3A to 3C are equivalent circuit diagrams illustrating structures of a multiplexer (MUX) in the organic light-emitting diode display device according to the exemplary embodiment.
Figure 3B:
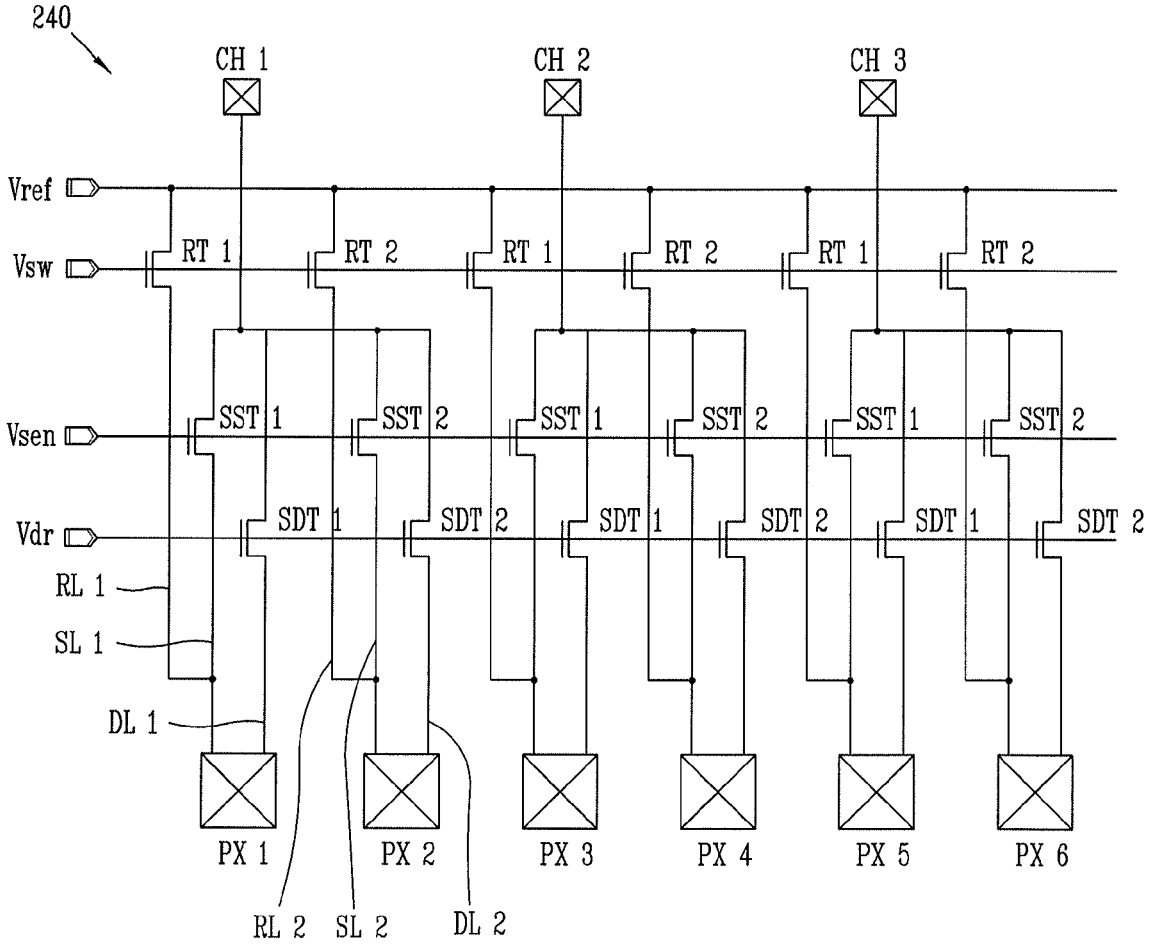
Figure 3C:
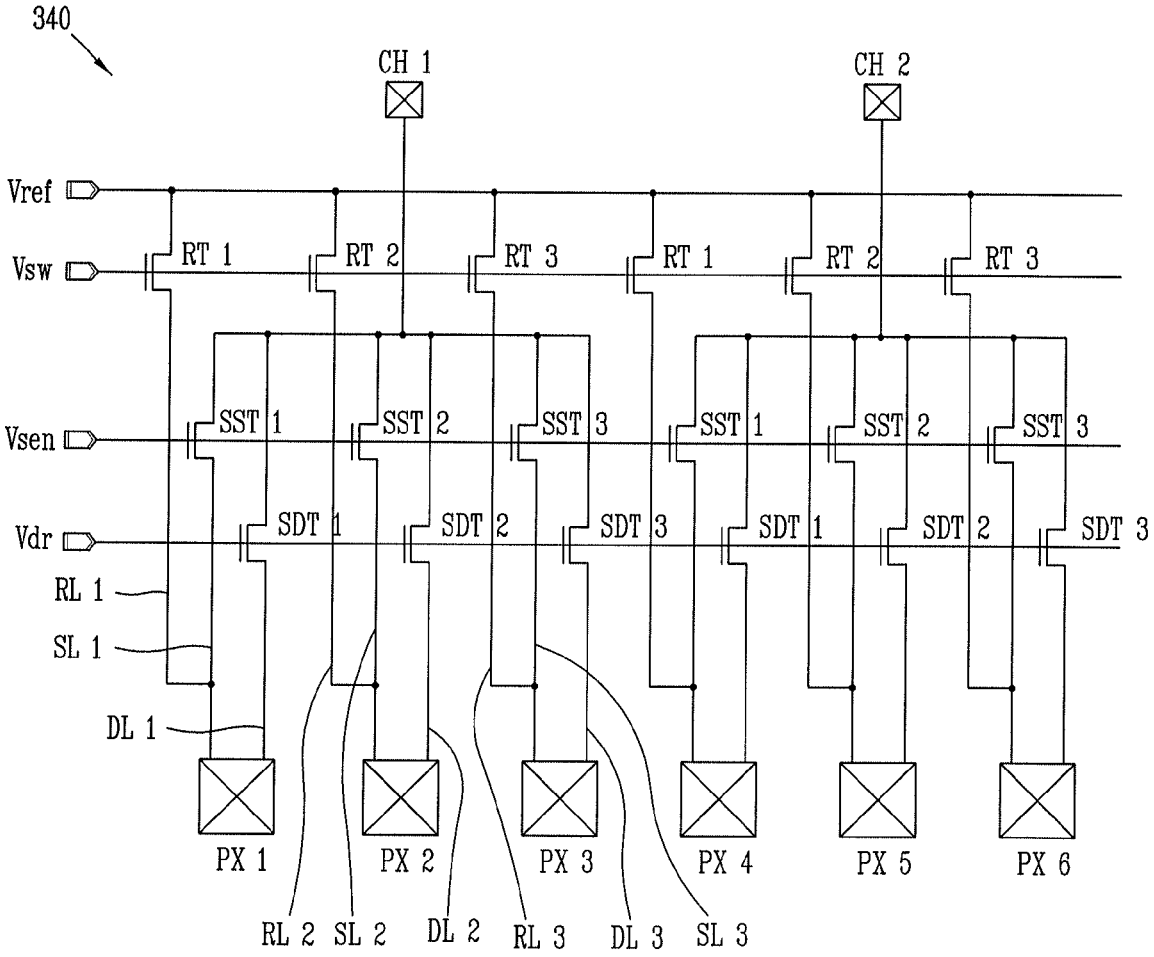

FIGS. 3A to 3C are equivalent circuit diagrams illustrating structures of MUXs in the organic light-emitting diode display device according to the exemplary embodiment.

1:1 Structure

FIG. 3A shows an example in which the pixels and the output terminals of the data driver are connected into a 1:1 structure. In the figure, six pixels PX1 to PX6 and six output terminals CH1 to CH6 are connected to each other.

The structure in which one pixel PX1 and one output terminal CH1 are connected to each other will be described with reference to this figure. The one pixel PX1 is connected to one reference voltage supply line RL, one reference voltage sensing line SL and one data line DL, and the lines are connected to the one output terminal CH1.

The MUX 140 includes an RT transistor RT connected between the reference voltage supply line RL and the reference voltage supply (not shown), and supplying a reference voltage Vref to the pixel PX1, corresponding to a reference control signal Vsw; an SST transistor SST connected between the output terminal CH1 and the reference voltage sensing line SL, and supplying the reference voltage Vref applied to the pixel PX1 to the output terminal CH1 of the data driver according to a sensing control signal Vsen; and an SDT transistor SDT connected between the output terminal CH1 and the data line DL, and supplying a data voltage Vdata to the pixel PX1 according to a driving control signal Vdr.

According to the structure described above, the reference voltage Vref is applied to the pixel PX1 when the reference control signal Vsw is applied to the MUX 140, and the sensing control signal Vsen is applied to the MUX 140 when the application of the reference voltage Vref is finished, so that the reference voltage Vref applied to the pixel PX1 is sensed through the output terminal CH1. Subsequently, when the application of the sensing control signal Vsen is finished, the driving control signal Vdr is applied to the MUX 140 so that the data voltage Vdata is applied to the pixel PX1.

The other pixels PX2 to PX6 and output terminals CH2 to CH6 are connected into the same structure.

1:2 Structure

FIG. 3B shows an example in which the pixels and the output terminals of the data driver are connected into a 1:2 structure. In this figure, six pixels PX1 to PX6 and three output terminals CH1 to CH3 are connected to each other.

The 1:2 structure is a structure in which adjacent first and second pixels and SST and SDT transistors SST and SDT respectively corresponding to the first and second pixels in a MUX 240 are connected to one output terminal.

The structure in which first and second pixels PX1 and PX2 are connected to one output terminal CH1 will be described with reference to this figure. The first pixel PX1 is connected to a first reference voltage supply line RL1, a first reference voltage sensing line SL1 and a first data line DL1, and the lines are connected to the one output terminal CH1. The second pixel PX2 is connected to a second reference voltage supply line RL2, a second reference voltage sensing line SL2 and a second data line DL2, and the lines are connected to the one output terminal CH1.

The MUX 240 includes first and second RT transistors RT1 and RT2 connected between the reference voltage supply (not shown) and the first and second reference voltage supply lines RL1 and RL2, and supplying a reference voltage Vref to the first and second pixels PX1 and PX2, corresponding to a reference control signal Vsw; first and second SST transistors SST1 and SST2 connected between the output terminal CH1 and the first and second reference voltage sensing lines SL1 and SL2, and supplying the reference voltage Vref applied to the first and second pixels PX1 and PX2 to the output terminal CH1 of the data driver according to a sensing control signal Vsen; and first and second SDT transistors SDT1 and SDT2 connected between the output terminal CH1 and the first and second data lines DL1 and DL2, and respectively supplying different data voltages Vdata to the first and second pixels PX1 and PX2 according to first and second driving control signals Vdr1 and Vdr2.

According to the structure described above, the reference voltage Vref is applied to the first and second pixels PX1 and PX2 when the reference control signal Vsw is applied to the MUX 240, and the sensing control signal Vsen is applied to the MUX 240 when the application of the reference voltage Vref is finished, so that the reference voltage Vref applied to the first and second pixels PX1 and PX2 is sensed through the output terminal C1.

Subsequently, when the application of the sensing control signal Vsen is finished, the first and second driving control signals Vdr1 and Vdr2 are applied to the MUX 240 so that the different data voltages are applied to the respective first and second pixel PX1 and PX2.

The other pixels PX2 to PX6 and output terminals CH2 and CH3 are connected into the same structure.

1:3 Structure

FIG. 3C shows an example in which the pixels and the output terminals of the data driver are connected into a 1:3 structure. In this figure, six pixels PX1 to PX6 and two output terminals CH1 and CH2 are connected to each other.

The 1:3 structure is a structure in which adjacent first to third pixels and SST and SDT transistors SST and SDT respectively corresponding to the first to third pixels in a MUX 340 are connected to one output terminal.

The structure in which first and third pixels PX1 to PX3 are connected to one output terminal CH1 will be described with reference to this figure. The first pixel PX1 is connected to a first reference voltage supply line RL1, a first reference voltage sensing line SL1 and a first data line DL1, and the lines are connected to the one output terminal CH1. The second pixel PX2 is connected to a second reference voltage supply line RL2, a second reference voltage sensing line SL2 and a second data line DL2. The third pixel PX3 is connected to a third reference voltage supply line RL3, a third reference voltage sensing line SL3 and a third data line DL3. The pixels PX1 to PX3 are connected to the one output terminal CH1.

The MUX 340 includes first to third RT transistors RT1 to RT3 connected between the reference voltage supply (not shown) and the first to third reference voltage supply lines RL1 to RL3, and supplying a reference voltage to the first to third pixels PX1 to PX3, corresponding to a reference control signal Vsw; first to third SST transistors SST1 to SST3 connected between the output terminal CH1 and the first to third reference voltage sensing lines SL1 to SL3, and supplying the reference voltage Vref applied to the first to third pixels PX1 to PX3 to the output terminal CH1 of the data driver according to a sensing control signal Vsen; and first to third SDT transistors SDT1 to SDT3 connected between the output terminal CH1 and the first to third data lines DL1 to DL3, and respectively supplying different data voltages to the first to third pixels PX1 to PX3 according to first to third driving control signals Vdr1 to Vdr3.

According to the structure described above, the reference voltage Vref is applied to the first to third pixels PX1 to PX3 when the reference control signal Vsw is applied to the MUX 340, and the sensing control signal Vsen is applied to the MUX 340 when the application of the reference voltage Vref is finished, so that the reference voltage Vref applied to the first to third pixels PX1 to PX3 is sensed through the output terminal CH1. Here, the sensing control signal Vsen is simultaneously applied to the first to third SST transistors SST1 to SST3, and thus the reference voltage Vref applied to the first to third pixels PX1 to PX3 is simultaneously applied to the output terminal CH1.

Subsequently, when the application of the sensing control signal Vsen is finished, the first to third driving control signals Vdr1 to Vdr3 are applied to the MUX 340 so that the different data voltages Vdata are applied to the respective first to third pixels PX1 to PX3.

The other pixels PX4 to PX6 and output terminal CH2 are connected into the same structure.

Meanwhile, in the exemplary embodiment described above, at least one reference voltage supply line, at least one reference voltage sensing line and at least one data line are formed in one pixel. That is, a plurality of signal lines are arranged in the one pixel. Hereinafter, another exemplary embodiment in which two pixels share any one of a plurality of signal lines with each other, thereby improving an aperture ratio will be described with reference to the accompanying drawings.

Figure 4:
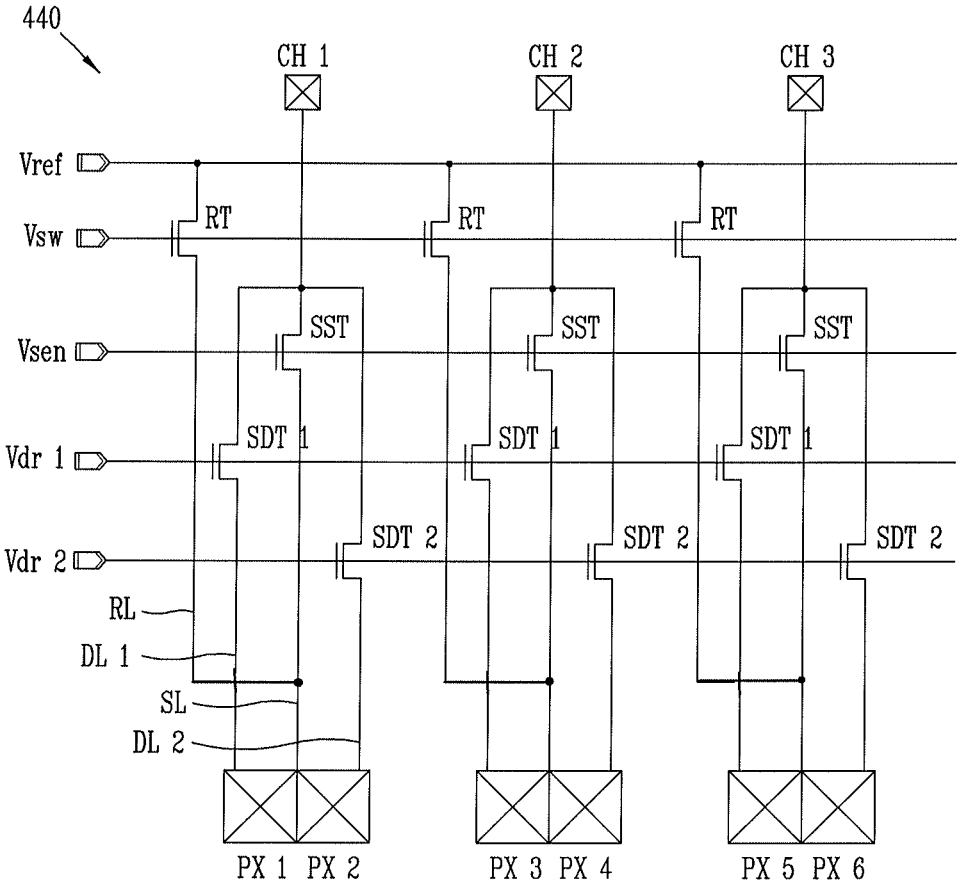
FIG. 4 is an equivalent circuit diagram illustrating the structure of a MUX in an organic light-emitting diode display device according to another exemplary embodiment.
Figure 5A:
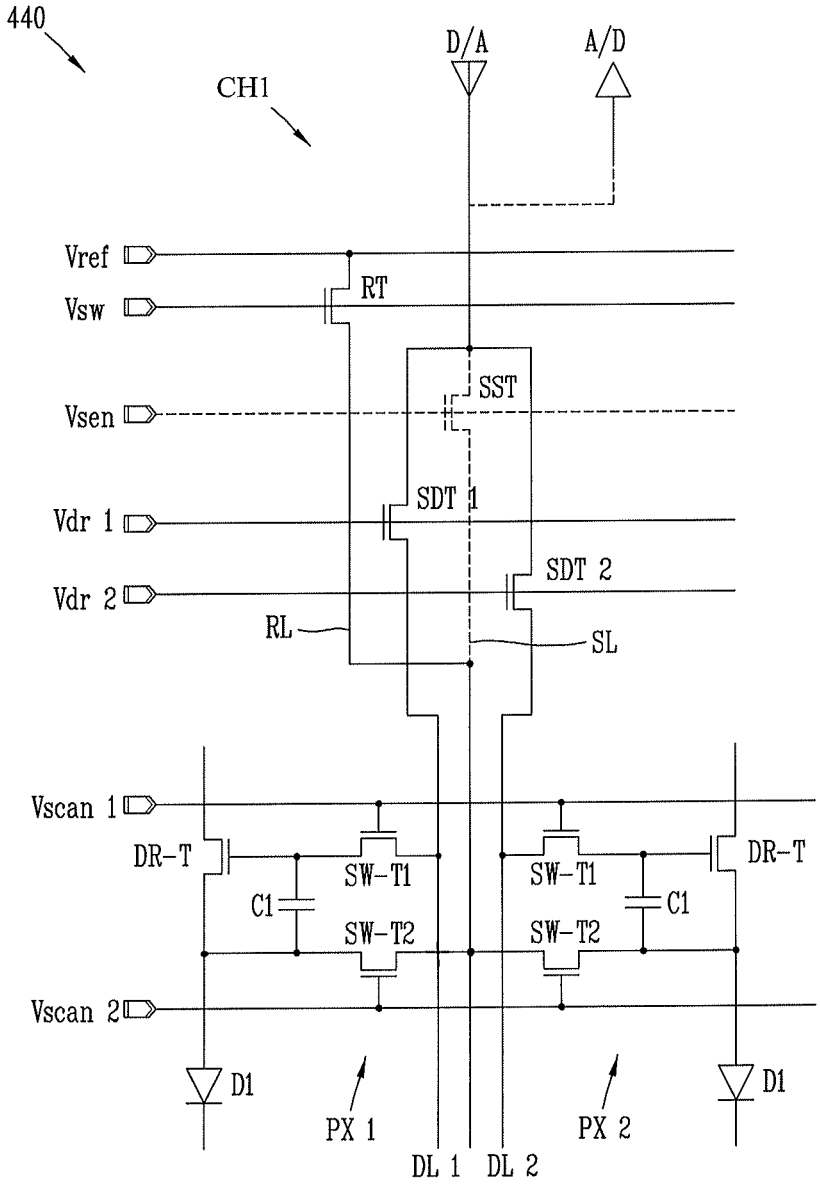
FIGS. 5A and 5B are circuit diagrams illustrating electrical connections of the MUX shown in FIG. 4.
Figure 5B:
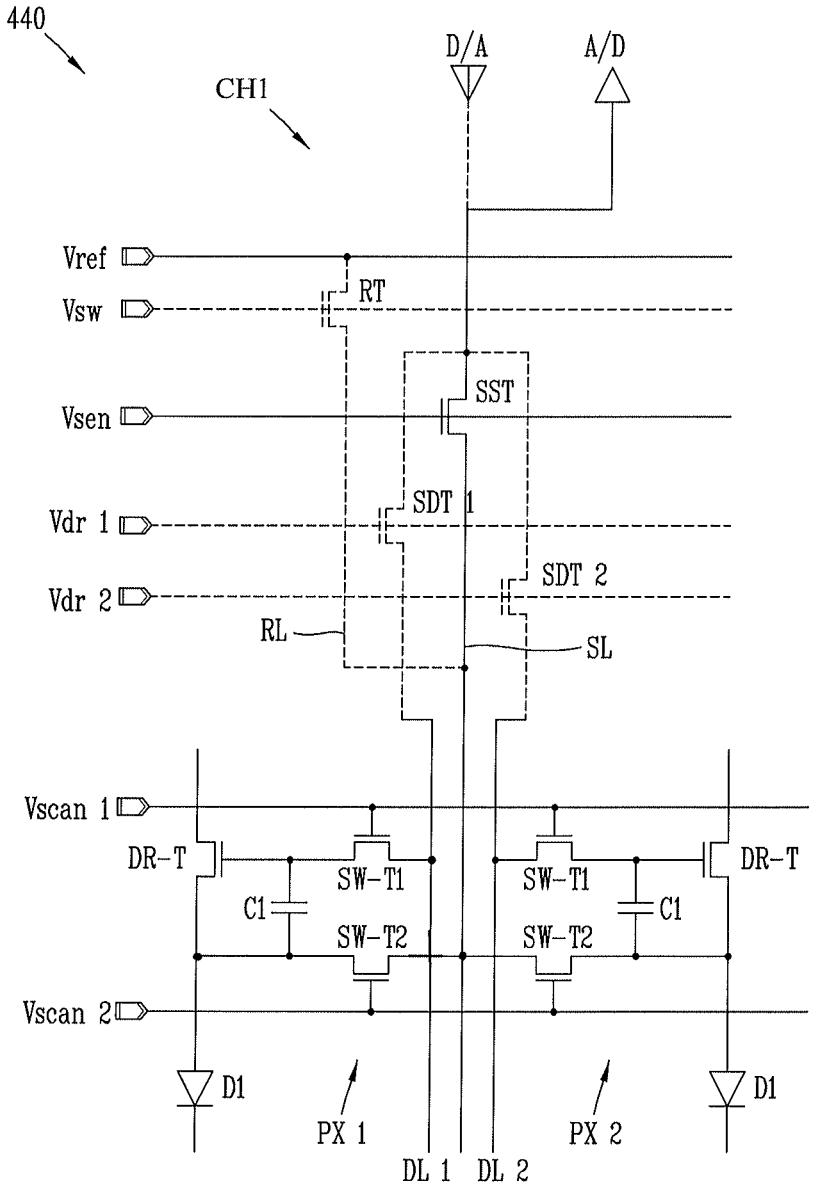

FIG. 4 is an equivalent circuit diagram illustrating the structure of a MUX in an organic light-emitting diode display device according to another exemplary embodiment. FIGS. 5A and 5B are circuit diagrams illustrating electrical connections of the MUX shown in FIG. 4.

FIG. 4 shows an example in which the pixels and the output terminals of the data driver are connected into the 1:2 structure. In this figure, six pixels PX1 to PX6 and three output terminals CH1 to CH3 are connected to each other. Here, each of the pixels PX1 to PX6 shares reference voltage supply and sensing lines between adjacent two pixels {(PX1 and PX2), (PX3 and PX4), (PX5 and PX6)}.

The structure in which first and second pixels PX1 and PX2 are connected to one output terminal CH1 will be described with reference to this figure. The first and second pixels PX1 and PX2 are connected to one reference voltage supply line RL and one reference voltage sensing line SL and first and second data lines DL1 and DL2, and the lines are connected to the one output terminal CH1.

A MUX 440 includes an RT transistor RT connected between the reference voltage supply line RL and the reference voltage supply (not shown), and supplying a reference voltage Vref to the first and second pixels PX1 and PX2, corresponding to a reference control signal Vsw; and an SST transistor SST connected between the output terminal CH1 and the reference voltage sensing line SL, and supplying the reference voltage Vref applied to the first and second pixels PX1 and PX2 to the output terminal CH1 of the data driver according to a sensing control signal Vsen.

The MUX 440 includes a first SDT transistor SDT1 connected between the output terminal CH1 and the first data line DL1, and supplying a data voltage Vdata to the first pixel PX1 according to a first driving control signal Vdr1; and a second SDT transistor SDT2 connected between the output terminal CH1 and the second data line DL2, and supplying a data voltage to the second pixel PX2 according to a second driving control signal Vdr2.

According to the structure described above, the reference voltage Vref is applied to the first and second pixels PX1 and PX2 when the reference control signal Vsw is applied to the MUX 440, and the sensing control signal Vsen is applied to the MUX 440 when the application of the reference voltage Vref is finished, so that the reference voltage Vref applied to the first and second pixels PX1 and PX2 is sensed through the output terminal CH1. Subsequently, when the application of the sensing control signal Vsen is finished, the first and second driving control signals Vdr1 and Vdr2 are applied to the MUX 440 at different times, so that the different data voltage Vdata are applied to the respective first and second pixels PX1 and PX2.

The other pixels PX3 to PX6 and output terminals CH2 and CH3 are connected into the same structure.

FIG. 5A is a circuit diagram illustrating a connection form of signal lines at the time when the reference voltage is supplied to the pixels. In this figure, if high-level first and second scan signals Vscan1 and Vscan2 are applied, current flows through the first and second switching transistors SW-T1 and SW-T2, and the reference voltage control signal Vsw is applied to the MUX 440, so that the reference voltage Vref is applied to one electrode of the capacitor C1 in each of the first and second pixels PX1 and PX2.

Simultaneously, the data voltage Vdata of an analog waveform is applied to the data line from the output terminal CH through a DAC (D/A). Here, a predetermined data voltage Vdata for sensing the reference voltage is applied to the other electrode of the capacitor C1 in each of the first and second pixels PX1 and PX2 through the first and second data lines DL1 and DL2. In this case, high-level first and second driving signals Vdr1 and Vdr2 are simultaneously applied to the respective first and second SDT transistors SDT1 and SDT2 so as to electrically connect the output terminal CH to the first and second data lines DL1 and DL2. Subsequently, although not shown in this figure, if the compensation of the data voltage is completed, the voltage levels of the first and second driving control signals Vdr1 and Vdr2 are changed into a high level at different times, so that data voltages Vdata according to gray scales are applied to the first and second pixels PX1 and PX2, respectively.

The sensing control signal Vsen has a low level, and the SST transistor SST maintains a turn-off state.

FIG. 5B is a circuit diagram illustrating a connection form of signal lines at the time when the reference voltage applied to the pixels is sensed. In this figure, the voltage level of the first scan signal Vscan1 is changed into a low level, and the second scan signal Vscan2 maintains the high level. Therefore, the first switching transistor SW-T1 is turned off, and the second switching transistor SW-T2 maintains a turn-on state. The voltage level of the reference voltage control signal Vsw is changed into the low level so that the reference voltage supply line RL is not connected to the first and second pixels PX1 and PX2.

Simultaneously, the voltage level of the sensing control signal Vsen is changed into the high level so that the reference voltage Vref of the analog waveform from the first and second pixels PX1 and PX2 is applied to the reference voltage sensing line SL from the output terminal CH through an ADC (A/D). Here, the reference voltage Vref becomes a reference voltage Vref changed by a difference in voltage between the driving transistors DR-T.

The voltage levels of the reference voltage control signal Vsw and the first and second driving control signals Vdr1 and Vdr2 are all changed into the low level, so that the reference voltage supply line RL and the first and second data lines DL1 and DL2 are disconnected from the output terminal CH. Thus, the data driver stably senses the reference voltage Vref.

Hereinafter, another exemplary embodiment in which two pixels share any one of a plurality of signal lines with each other, thereby improving an aperture ratio will be described with reference to the accompanying drawing.

Figure 6:
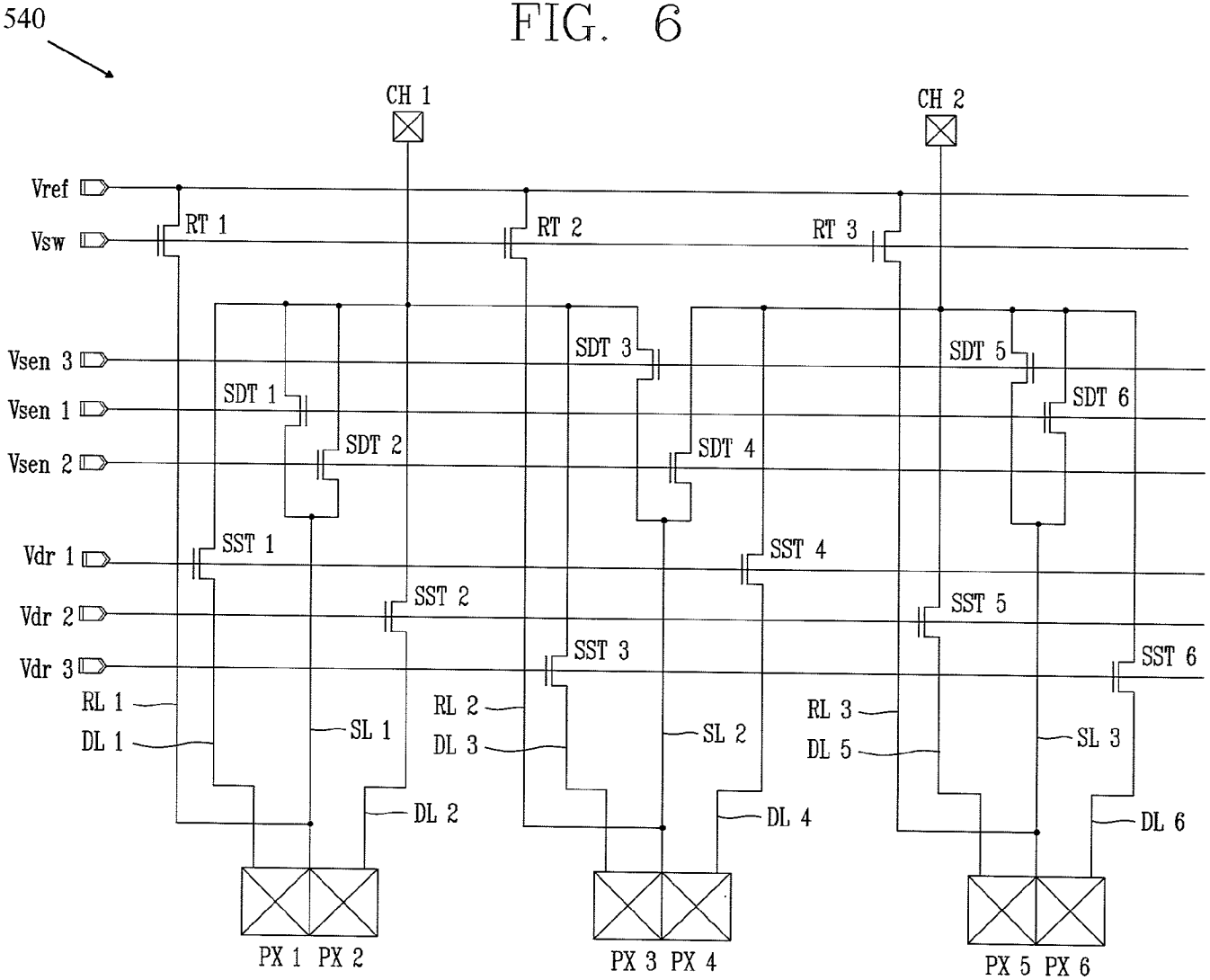
FIG. 6 is an equivalent circuit diagram illustrating the structure of a MUX in an organic light-emitting diode display device according to still another exemplary embodiment.

FIG. 6 is an equivalent circuit diagram illustrating the structure of a MUX in an organic light-emitting diode display device according to still another exemplary embodiment.

FIG. 6 shows an example in which the pixels and the output terminals of the data driver are connected into a 6:2 structure. In this figure, six pixels PX1 to PX6 and two output terminals CH1 and CH2 are connected to each other. Here, each of the pixels PX1 to PX6 shares reference voltage supply lines RL1 to RL3 and reference voltage sensing lines SL1 to SL3 between adjacent two pixels {(PX1 and PX2), (PX3 and PX4), (PX5 and PX6)}. Each of the reference voltage sensing lines SL1 to SL3 is divided into two lines, and the divided lines are connected to first to six SST transistors SST1 to SST6, respectively Referring to this figure, the first and second pixels PX1 and PX2 are connected to a first reference voltage supply line RL1, first and second reference voltage sensing lines SL1 and SL2, and first and second data lines DL1 and DL2, and the lines are connected to the first output terminal CH1.

The third and fourth pixels PX3 and PX4 are connected to a second reference voltage supply line RL2, third and fourth reference voltage sensing lines SL3 and SL4, and third and fourth data lines DL3 and DL4, and the lines are connected to the first and second output terminals CH1 and CH2.

The fifth and sixth pixels PX5 and PX6 are connected to a third reference voltage supply line RL3, fifth and sixth reference voltage sensing lines SL5 and SL5, and fifth and sixth data lines DL5 and DL5, and the lines are connected to the second output terminal CH2.

A MUX 540 includes a first RT transistor RT1 connected between the first reference voltage supply line RL1 and the reference voltage supply (not shown), and supplying a reference voltage Vref to the first and second pixels PX1 and PX2, corresponding to a reference control signal Vsw; a second RT transistor RT2 connected between the second reference voltage supply line SL2 and the reference voltage supply (not shown), and supplying a reference voltage signal Vref to the third and fourth pixels PX3 and PX4, corresponding to the reference control signal Vsw; and a third RT transistor RT3 connected between the third reference voltage supply line RL3 and the reference voltage supply (not shown), and supplying a reference voltage Vref to the fifth and sixth pixels PX5 and PX6, corresponding to the reference control signal Vsw.

The MUX 540 includes a first SST transistor SST1 connected between the first output terminal CH1 of the data driver and the first reference voltage sensing line SL1, and supplying the reference voltage Vref applied to the first pixel PX1 to the first output terminal CH1 according to a first sensing control signal Vsen1; a second SST transistor SST2 connected between the first output terminal CH1 and the second reference voltage sensing line SL2, and supplying the reference voltage Vref applied to the second pixel PX2 to the first output terminal CH1 according to a second sensing control signal Vsen2; a third SST transistor SST3 connected between the first output terminal CH1 and the second reference voltage sensing line SL2, and supplying the reference voltage Vref applied to the third pixel PX3 to the first output terminal CH1 according to a third sensing control signal Vsen3; a fourth SST transistor SST4 connected between the second output terminal CH2 of the data driver and the second reference voltage sensing line SL2, and supplying the reference voltage applied to the fourth pixel PX4 to the second output terminal CH2 according to the second sensing control signal Vsen2; a fifth SST transistor SST5 connected between the second output terminal CH2 and the third reference voltage sensing line SL3, and supplying the reference voltage applied to the fifth pixel PX5 to the second output terminal CH2 according to the third sensing control signal Vsen3; and a sixth SST transistor SST6 connected between the second output terminal CH2 and the third reference voltage sensing line SL3, and supplying the reference voltage applied to the fifth pixel PX5 to the second output terminal CH2 according to the first sensing control signal Vsen1.

The MUX 540 includes a first SDT transistor SDT1 connected between the first output terminal CH1 and the first data line DL1, and supplying a data voltage Vdata to the first pixel PX1 according to a first driving control signal Vdr1; a second SDT transistor SDT2 connected between the first output terminal CH1 and the second data line DL2, and supplying a data voltage Vdata to the second pixel PX2 according to a second driving control signal Vdr2; a third SDT transistor SDT3 connected between the first output terminal CH1 and the third data line DL3, and supplying a data voltage Vdata to the third pixel PX3 according to a third driving control signal Vdr3; a fourth SDT transistor SDT4 connected between the second output terminal CH2 and the fourth data line DL4, and supplying a data voltage Vdata to the fourth pixel PX4 according to a fourth driving control signal Vdr4; a fifth SDT transistor SDT5 connected between the second output terminal CH2 and the fifth data line DL5, and supplying a data voltage Vdata to the fifth pixel PX5 according to a fifth driving control signal Vdr5; and a sixth SDT transistor SDT6 connected between the second output terminal CH2 and the sixth data line DL6, and supplying a data voltage Vdata to the sixth pixel PX6 according to a sixth driving control signal Vdr6.

According to the structure described above, the reference voltage Vref is applied to all the pixels PX1 to PX6 when the reference control signal Vsw is applied to the MUX 540, and the sensing control signals Vsen1 to Vsen3 are sequentially applied to the MUX 540 when the application of the reference voltage Vref is finished. Therefore, the reference voltages Vref applied to the first and second pixels PX1 and PX2 and the fifth and sixth pixels PX5 and PX6 are first sensed through the first and second output terminals CH1 and CH2, respectively, and the reference voltages Vref applied to the first and second pixels PX1 and PX2 and the third and fourth pixels PX3 and PX4 are then sensed through the first and second output terminals CH1 and CH2, respectively. Subsequently, the reference voltages applied to the third and fourth pixels PX3 and PX4 and the fifth and sixth pixels PX5 and PX6 are sensed through the first and second output terminals CH1 and CH2, respectively.

Subsequently, when the application of the first to third sensing control signals Vsen1 to Vsen3 is finished, the first to third driving control signals Vdr1 to Vdr3 are sequentially applied to the MUX 540 at different times, so that different data voltages Vdata are sequentially applied to the first and fourth pixels PX1 and PX4, the second and fifth pixels PX2 and PX5 and the third and sixth pixels PX3 and PX6, respectively.

In the organic light-emitting diode display device according to exemplary embodiments, the MUX is provided between the data driver and the pixels, and each pixel and signal lines are selectively connected through the MUX, so that it is possible to reduce the number of Integrated chips (ICs) provided by allowing a compensation circuit built in the data driver.

Further, a signal line is formed between adjacent pixels, and the two pixels share the signal line with each other, thereby improving an aperture ratio.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An organic light-emitting diode display device, comprising:

a display panel having a plurality of signal lines formed thereon, and including a plurality of pixels, the plurality of signal lines including a data line and a reference voltage sensing line for each pixel;

a gate driver that allows current to flow through a gate line;

a data driver that computes a variation in threshold voltage of a driving transistor of each pixel by sensing a change in reference voltage applied through the signal lines, and compensates for a data voltage applied to the driving transistor and supplies the compensated data voltage to the pixel;

a multiplexer (MUX) that is disposed between the data driver and the data line and the reference voltage sensing line of the pixels and that provides the sole control of an electrical connection between one of output terminals of the data driver and the reference voltage sensing line and the data line of a corresponding pixel, in response to a sensing control signal and a driving control signal supplied to the multiplexer, respectively, the pixels being arranged into a 1:1, 1:N (N is a natural number) or N:N structure, the multiplexer including a first switching transistor connected between the reference voltage sensing line and the one of the output terminals of the data driver and a second switching transistor connected between the data line and the same one of the output terminals of the data driver; and a timing controller that controls the gate driver, the data driver and the MUX.

2. The organic light-emitting diode display device of claim 1, wherein the signal lines further include a reference voltage supply line.

3. The organic light-emitting diode display device of claim 2, wherein the reference voltage supply line and the reference voltage sensing line are electrically connected to each other.

4. The organic light-emitting diode display device of claim 2, wherein the MUX includes:

an RT transistor connected between the reference voltage supply line and a reference voltage supply part, and supplying the reference voltage to the pixel, corresponding to a reference control signal;

wherein the first switch transistor is an SST transistor connected between the one of the output terminals and the reference voltage sensing line, and supplying the reference voltage applied to the pixel to the data driver according to the sensing control signal; and wherein the second switching transistor is an SDT transistor connected between the one of the output terminals and the data line, and supplying the data voltage to the pixel according to the driving control signal.

5. The organic light-emitting diode display device of claim 4, wherein the SST and SDT transistors of the first and second adjacent pixels are connected to one output terminal in the MUX.

6. The organic light-emitting diode display device of claim 2, wherein the SST and SDT transistors of the first to third adjacent pixels are connected to one output terminal in the MUX.

7. The organic light-emitting diode display device of claim 2, wherein the adjacent first and second pixels are respectively connected to first and second data lines, and wherein the MUX includes:

an RT transistor connected between the reference voltage supply line and the reference voltage supply part, and that supplies the reference voltage to the first and second pixels, corresponding to a reference control signal;

an SST transistor connected between the one of the output terminals and the reference voltage sensing line, and that supplies the reference voltage applied to the first and second pixels to the data driver according to the sensing control signal;

a first SDT transistor connected between the one of the output terminals and the first data line, and that supplies the data voltage to the first pixel according to a first driving control signal; and a second SDT transistor connected between the one of the output terminals and the second data line, and that supplies the data voltage to the second pixel according to a second driving control signal.

8. The organic light-emitting diode display device of claim 7, wherein the reference voltage supply line is between the first and second pixels.

9. The organic light-emitting diode display device of claim 2, wherein the adjacent first to sixth pixels are respectively connected to first to sixth data lines, wherein the reference voltage supply line is divided into first to third reference voltage supply lines, and the reference voltage sensing line is divided into first to third reference voltage sensing lines, and wherein the MUX includes:

a first RT transistor connected between the first reference voltage supply line and the reference voltage supply part, and that supplies the reference voltage to the first and second pixels, corresponding to a reference control signal;

a second RT transistor connected between the second reference voltage supply line and the reference voltage supply part, and that supplies the reference voltage to the third and fourth pixels, corresponding to the reference control signal;

a third RT transistor connected between the third reference voltage supply line and the reference voltage supply part, and that supplies the reference voltage to the fifth and sixth pixels, corresponding to the reference control signal;

a first SST transistor connected between a first output terminal of the data driver and the first reference voltage sensing line, and that supplies the reference voltage applied to the first pixel to the data driver according to a first sensing control signal;

a second SST transistor connected between the first output terminal and the first reference voltage sensing line, and that supplies the reference voltage applied to the second pixel to the data driver according to a second sensing control signal;

a third SST transistor connected between the first output terminal and the second reference voltage sensing line, and that supplies the reference voltage applied to the third pixel to the data driver according to a third sensing control signal;

a fourth SST transistor connected between a second output terminal of the data driver and the second reference voltage sensing line, and that supplies the reference voltage applied to the fourth pixel to the data driver according to the second sensing control signal;

a fifth SST transistor connected between the second output terminal and the third reference voltage sensing line, and that supplies the reference voltage applied to the fifth pixel to the data driver according to the third sensing control signal;

a sixth SST transistor connected between the second output terminal and the third reference voltage sensing line, and that supplies the reference voltage applied to the sixth pixel to the data driver according to the first sensing control signal;

a first SDT transistor connected between the first output terminal and the first data line, and that supplies the data voltage to the first pixel according to a first driving control signal;

a second SDT transistor connected between the first output terminal and the second data line, and that supplies the data voltage to the second pixel according to a second driving control signal;

a third SDT transistor connected between the first output terminal and the third data line, and that supplies the data voltage to the third pixel according to a third driving control signal;

a fourth SDT transistor connected between the second output terminal and the fourth data line, and that supplies the data voltage to the fourth pixel according to the first driving control signal;

a fifth SDT transistor connected between the second output terminal and the fifth data line, and that supplies the data voltage to the fifth pixel according to the second driving control signal; and a sixth SDT transistor connected between the second output terminal and the sixth data line, and that supplies the data voltage to the sixth pixel according to the third driving control signal.

10. The organic light-emitting diode display device of claim 9, wherein the first to third reference voltage supply lines are between the first and second pixels, between the third and fourth pixels and between the fifth and sixth pixels, respectively.

11. The organic light-emitting diode display device of claim 1 wherein a power voltage line or ground voltage line among the signal lines is formed between adjacent two pixels.

12. The organic light-emitting diode display device of claim 4, wherein a power voltage line or ground voltage line among the signal lines is formed between adjacent two pixels.

13. The organic light-emitting diode display device of claim 7, wherein a power voltage line or ground voltage line among the signal lines is formed between adjacent two pixels.

14. The organic light-emitting diode display device of claim 9, wherein a power voltage line or ground voltage line among the signal lines is formed between adjacent two pixels.

* * * * *